US005875786A

United States Patent [19]

Chase

[11] Patent Number: 5,875,786

[45] **Date of Patent: *Mar. 2, 1999**

[54] CIGAR SUBSTITUTE

[76] Inventor: Gene Chase, 2006 Delaware Ave., #2, Buffalo, N.Y. 14216-3528

[ * ] Notice: The term of this patent shall not extend beyond the expiration date of Pat. No. 5,666,979.

[21] Appl. No.: 929,035

[22] Filed: Sep. 15, 1997

Related U.S. Application Data

[63] Continuation-in-part of Ser. No. 314,849, Sep. 29, 1994, Pat. No. 5,666,979.

[51] Int. Cl.[6] ..... A24F 47/00

[52] U.S. Cl. ..... 131/270; 131/271; 131/273

[58] Field of Search ..... 131/270, 271, 131/272, 273, 359

[56] References Cited

U.S. PATENT DOCUMENTS

| | | | |
|---|---|---|---|
| 3,877,468 | 4/1975 | Lichtneckert et al. | 131/270 |
| 4,237,884 | 12/1980 | Erickson et al. | 131/270 |
| 4,774,971 | 10/1988 | Vieten | 131/270 |
| 4,778,677 | 10/1988 | Ebbesen | 131/270 |
| 4,784,641 | 11/1988 | White | 131/270 |
| 4,907,605 | 3/1990 | Ray et al. | 131/270 |
| 4,971,079 | 11/1990 | Talapin et al. | 131/270 |
| 5,016,652 | 5/1991 | Rose et al. | 131/270 |
| 5,048,544 | 9/1991 | Mascarelli | 131/270 |
| 5,181,505 | 1/1993 | Lew et al. | 131/270 |
| 5,377,879 | 1/1995 | Isaacs | 131/270 |
| 5,500,433 | 3/1996 | Carr et al. | 131/270 |
| 5,666,979 | 9/1997 | Chase | 131/270 |

FOREIGN PATENT DOCUMENTS

| | | | |
|---|---|---|---|
| PCT/DK90/00380 | 5/1991 | WIPO | 131/270 |

*Primary Examiner*—John G. Weiss
*Assistant Examiner*—Charles Anderson
*Attorney, Agent, or Firm*—The Bilicki Law Firm, P.C.

[57] ABSTRACT

A cigar substitute, comprising an elongate, inedible, flexible tube having a length such that when one end is held in the mouth, the other end protrudes out of the mouth and having at least one lumen containing a mixture comprising nicotine, nicotine derivative, nicotine substitute or nicotine substitute derivative, an edible carrier, and a flavoring substance.

3 Claims, 1 Drawing Sheet

CIGAR SUBSTITUTE

This is a continuation-in-part of U.S. patent application Ser. No. 08/314,849 filed on Sep. 29, 1994, now U.S. Pat. No. 5,666,979.

FIELD OF THE INVENTION

The present invention relates to anti-smoking devices. More specifically, it relates to a cigar substitute that suppresses the desire for tobacco and satisfies the need of smokers to chew the end of a cigar and manually manipulate the cigar.

BACKGROUND OF THE INVENTION

The hazardous effects of tobacco use and environmental smoke are well documented. As a result, a clear need has developed for reducing the incidence of smoking. One of the principal problems associated with reducing the incidence of smoking is the fact that smokers generally acquire a dependency on a certain level of nicotine in their blood stream. Cigar and cigarette smokers also develop a habit of manually manipulating the cigar or cigarette. In addition, cigar smokers are known to enjoy chewing the end of a cigar.

In the past, various products have been developed that provide nicotine or nicotine substitutes so as to assist smokers in ending their smoking habit. Such devices include products that deliver nicotine and/or its substitutes to the blood via the oral cavity, the nasal cavity or the skin.

Products that deliver nicotine via the oral cavity include gums, tablets or lozenges. Nicotine is released into the oral cavity and subsequently absorbed through the buccal mucosa by chewing the gum or sucking the lozenges. U.S. Pat. No. 3,877,468 to Lichtneckert et al., and U.S. Pat. No. 4,971,079 to Talpin et al., disclose chewable tobacco substitute products. U.S. Pat. No. 4,907,605 to Ray et al., discloses oral tobacco substitutes. U.S. Pat. No. 5,048,544 to Mascarelli discloses a nicotine lollipop. Danish Patent No. WO91/06288 to Anders discloses lozenges and tablets containing tobacco substitutes. These preparations are not cost-effective and do not provide for the manual manipulation that smokers are typically used to. Furthermore, these devices may be swallowed whole, voiding any possible benefit to the user. When swallowed accidentally, these preparations may result in an overdose of nicotine.

Other devices deliver nicotine to the bloodstream via the nasal cavity or the skin. U.S. Pat. No. 5,016,652 to Rose et al., discloses transdermal patches that slowly release nicotine or nicotine substitutes which are then absorbed through the skin. These devices do not provide for oral or manual stimulation to the user and may cause skin irritation. Another product, 'Nicotine Nasal Spray' manufactured by Kabi Pharmacia, is sprayed into the nasal cavity. It does not provide manual or oral stimulation and may cause nasal irritation to the user.

Still other devices designed to assist smokers to quit smoking are aimed at satisfying a cigarette smoker's psychological need to manually manipulate the cigarette. These devices include cigarette substitutes that may or may not contain nicotine or nicotine substitutes. U.S. Pat. No. 4,774,971 to Vieten discloses such a cigarette substitute. These products typically involve complex manufacturing processes and either do not provide substances to reduce the desire to smoke or use a nicotine product that can be swallowed as a whole. In addition, these products cannot be chewed and therefore do not address the need of a cigar smoker to chew on the end of the cigar.

Thus, although several devices are available that provide nicotine or nicotine substitutes, none of the devices specifically addresses a cigar smoker's habit of chewing on the end of a cigar as it is smoked, while allowing the user to remove the cigar from the mouth and manipulate it in the hands. Therefore, what is needed is a device that will not only provide chemicals to suppress the desire to smoke but will also simulate smoking of a real cigar in that it will allow the user to chew the end of the device and will satisfy the psychological need of a smoker to manually manipulate it.

SUMMARY OF THE INVENTION

This invention broadly comprises a cigar substitute comprised of an elongated, inedible, flexible tube having a first end and a second end and having a length such that when the first end of the tube is held in the user's mouth, the second end protrudes out of the mouth, and having at least one lumen containing a mixture comprising nicotine, nicotine derivative, nicotine substitute or nicotine substitute derivative, an edible carrier, and a flavoring substance.

An object of the present invention is to provide a simple, inexpensive cigar substitute that is not easily swallowed and contains substances that reduces the desire to smoke.

Another object of the invention is provide a cigar substitute that allows a user to manually manipulate the cigar.

A still further object of the invention is to provide a cigar substitute the end of which can be chewed by the user.

DESCRIPTION OF THE PREFERRED EMBODIMENT

As illustrated in FIGS. 1–4, the present invention comprises an elongated, inedible, flexible tube 10 with one or more lumens 11. The tube is preferably made of an inedible and flexible material including, but not limited to, polyethylene and polypropylene. In a preferred embodiment, the tubes are "cocktail straws" or "swizzle sticks" which are commonly used to stir mixed drinks.

Figure 1:
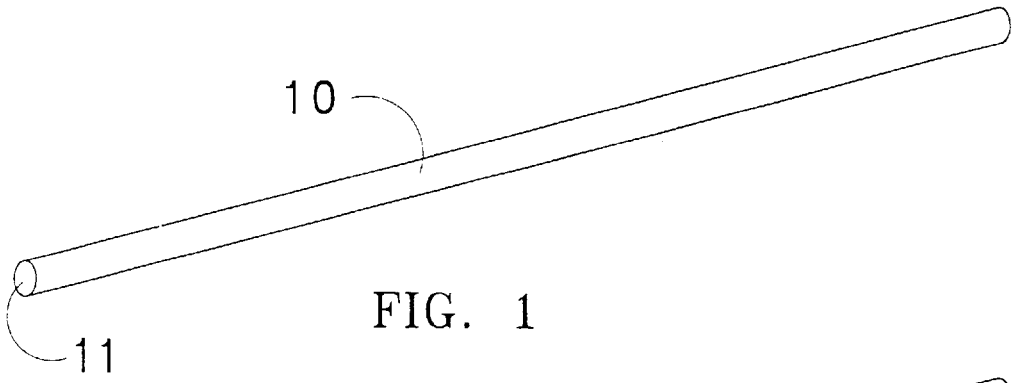
FIG. 1 is a perspective view of a cigar substitute showing a tube with one lumen.
Figure 2:
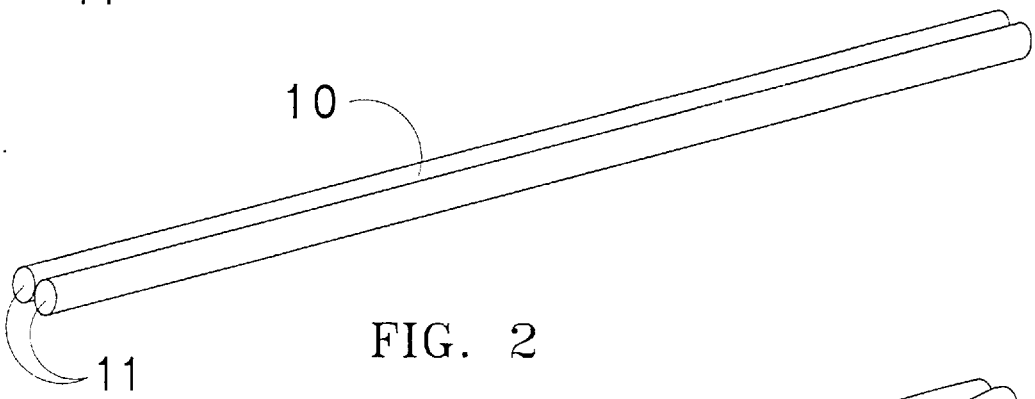
FIG. 2 is a perspective view of a cigar substitute showing a tube with two lumens.
Figure 3:
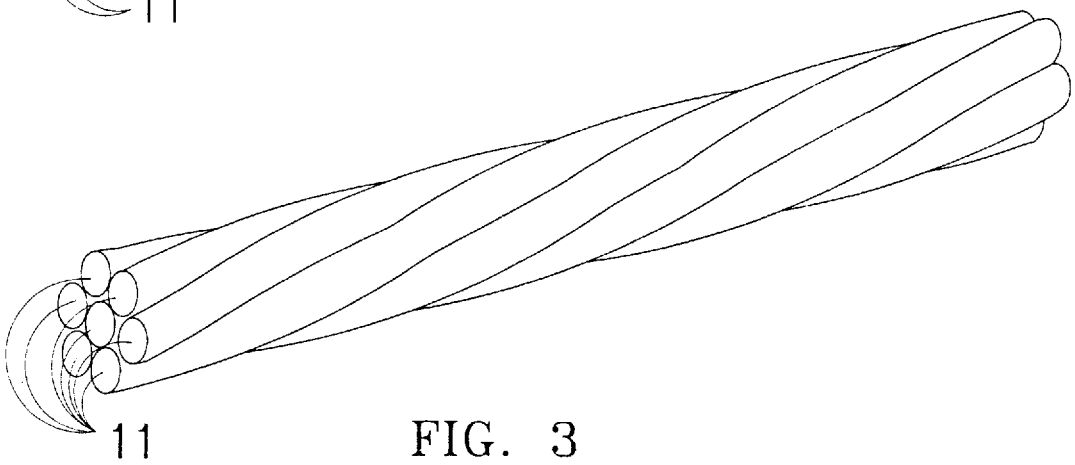
FIG. 3 is a perspective view of a cigar substitute containing multiple lumens in a twisted configuration.

As illustrated in FIGS. 1, 2 and 3, the tubes may have one or more lumens held together along their length by any of the standard means known in the art. The lumens may also take various configurations without departing from the spirit and scope of this invention. Thus, in a multi-lumen tube, the lumens may be straight (FIG. 2) or may twist around each other (FIG. 3). At least one lumen of the tube is filled with a substance known to reduce the desire to smoke. Such substances include, but are not limited to, nicotine, nicotine derivatives, nicotine substitutes, and nicotine substitute derivatives. The term "nicotine substitute" as used herein means any substance known to reduce the desire to smoke or use tobacco, such as lobeline sulfate. In a preferred embodiment, the quantity of nicotine, nicotine substitute, nicotine derivative or nicotine substitute derivative is sufficient to reduce the desire to smoke. In a more preferred embodiment, this quantity is 4 milligrams per unit. The lumen also contains an edible carrier. An example of a suitable carrier is gelatin. In addition, a flavoring substance is also added to the lumen so as to impart a pleasant taste to the mixture. In a preferred embodiment, the flavoring substance is mint extract.

Figure 4:
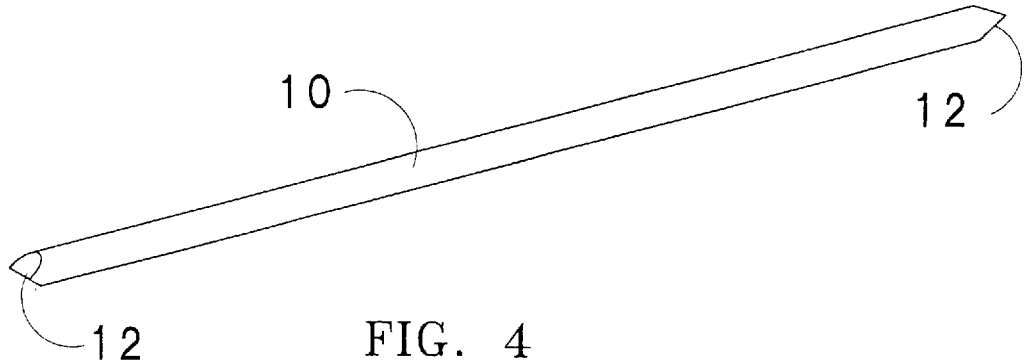
FIG. 4 is a perspective view of a cigar substitute showing a tube with one lumen with sealed ends.

One or both ends of the tube lumens are sealed by any of the standard means. Such means include, but are not limited to, pinching, plugging, folding, thermosetting and ultrasound. In a preferred embodiment, the tube lumen is sealed by thermosetting. A sealed lumen 12 of a tube is illustrated in FIG. 4.

The cigar substitute of the present invention is designed to simulate smoking of a real cigar. The dimensions of the tube are such that when one end of the tube is held in the mouth by the user, the other end protrudes out of the mouth so as to mimic the feeling of holding a real cigar in the mouth. The length of the tube protruding from the mouth should be such that it can be easily held in the user's fingers and manipulated. Thus, while the dimensions of the tube can vary, in a preferred embodiment, the length of the tube protruding from the mouth is between about 1 centimeter to about 30 centimeters. In more preferred embodiment, this length is approximately 13 centimeters.

When the urge for tobacco is felt, the user will place one end of the tube in the mouth, the other end protruding out of the mouth. The end of the tube held in the mouth is gently chewed simulating chewing the end of a real cigar. This breaks the seal of the tube. Further chewing slowly releases the contents of the lumen into the oral cavity. The contents get absorbed through the buccal mucosa and when a certain level of nicotine in the blood is reached, the pharmacological desire to smoke is reduced. The tube may be removed from the mouth anytime and manipulated in the hands, simulating the holding and ashing rituals of smoking.

The present invention is easily and inexpensively manufactured by extrusion, provides for oral and manual manipulation by the user, provides substances to suppress the pharmacological desire to smoke, will not stick to or damage dental work, will not cause skin or nasal irritation to the user, is difficult to swallow, and simulates chewing the end of a cigar when in use. The unique design also eliminates the need for elaborate packaging to contain substances inside the tube lumens.

The preferred embodiments as described above are not intended to define and limit the scope of the present invention. It is appreciated that various modification to the inventive concepts described herein may be apparent to those skilled in the art without departing from the spirit of the present invention defined by the hereinafter appended claims.

What is claimed is:

1. A cigar substitute, comprising an elongate, inedible, flexible tube having a first end and a second end, said tube having a length such that when said first end is held in the mouth, said second end protrudes out of the mouth, and having at least one lumen, said lumen containing a mixture comprising:

a substance selected from the group consisting of nicotine, nicotine derivative, nicotine substitute and nicotine substitute derivative;

an edible carrier; and a flavoring substance.

2. The cigar substitute of claim 1, wherein said second end has a length of between about 1 centimeter to about 30 centimeters.

3. The cigar substitute of claim 2, wherein said second end has a length of approximately 13 centimeters.

* * * * *